US006325220B1

(12) United States Patent
Malmström

(10) Patent No.: US 6,325,220 B1
(45) Date of Patent: Dec. 4, 2001

(54) RACK FOR DISHES IN A DISHWASHER

(75) Inventor: Niklas Malmström, Malmö (SE)

(73) Assignee: G S Development AB, Malmo (SE)

( * ) Notice: Subject to any disclaimer, the term of this patent is extended or adjusted under 35 U.S.C. 154(b) by 0 days.

(21) Appl. No.: 09/380,884

(22) PCT Filed: Apr. 1, 1998

(86) PCT No.: PCT/SE98/00601

§ 371 Date: Nov. 12, 1999

§ 102(e) Date: Nov. 12, 1999

(87) PCT Pub. No.: WO98/46113

PCT Pub. Date: Oct. 22, 1998

(30) Foreign Application Priority Data

Apr. 3, 1997 (SE) ..... 9701204

(51) Int. Cl.[7] ..... A47G 19/08
(52) U.S. Cl. ..... 211/41.8; 211/41.9; 211/41.1
(58) Field of Search ..... 24/41.8, 41.9, 24/41.2, 41.3, 41.4, 41.5, 41.6

(56) References Cited

U.S. PATENT DOCUMENTS

| | | | | |
|---|---|---|---|---|
| D. 368,340 | * | 3/1996 | Mussmacher et al. | D32/3 |
| 2,516,088 | * | 7/1950 | Einhorn | 211/41.1 |
| 3,752,322 | | 8/1973 | Fiocca et al. | 211/41 |
| 3,768,883 | * | 10/1973 | Kauffman | 312/351 |
| 3,795,073 | * | 3/1974 | Olsen | 43/105 |
| 3,809,450 | * | 5/1974 | Guth | 312/351 |
| 4,046,261 | * | 9/1977 | Yake | 211/41.8 |
| 4,251,894 | * | 2/1981 | Hollingsworth | 9/309 |
| 4,346,907 | * | 8/1982 | Swann | 280/47.18 |
| 4,561,676 | * | 12/1985 | Trubiano | 280/801 |
| 4,621,739 | * | 11/1986 | Heymann et al. | 211/74 |
| 4,732,291 | | 3/1988 | McConnell | 220/19 |
| 4,738,216 | * | 4/1988 | Camarota et al. | 114/249 |
| 4,830,200 | * | 5/1989 | Zambano et al. | 211/181 |
| 4,832,206 | * | 5/1989 | Cunningham | 211/41.1 |
| 4,836,392 | * | 6/1989 | Constantino | 211/181 |
| 4,869,375 | * | 9/1989 | Lamb | 211/41.1 |
| 4,909,401 | * | 3/1990 | McConnell | 211/74 |
| 4,927,033 | * | 5/1990 | Patera et al. | 211/41.1 |
| 4,969,560 | * | 11/1990 | Stanfield | 211/41.8 |
| 4,974,806 | | 12/1990 | Matern | 248/499 |
| 5,158,185 | * | 10/1992 | Michael et al. | 211/41.1 |
| 5,201,826 | | 4/1993 | Zimmerman | 211/41 |
| 5,294,008 | | 3/1994 | Dunaway | 211/41 |
| 5,344,029 | * | 9/1994 | Oghia et al. | 211/41.8 |
| 5,383,259 | * | 1/1995 | McIntire | 24/300 |
| 5,386,989 | * | 2/1995 | Broadway | 273/29 A |
| 5,405,018 | * | 4/1995 | Anthrop, Jr. | 211/13.1 |
| 5,497,890 | | 3/1996 | Clark | 211/41 |
| 5,518,126 | * | 5/1996 | Davis | 211/41.8 |
| 5,912,433 | * | 6/1999 | Pulido et al. | 174/77 R |
| 5,921,900 | * | 7/1999 | Mankovitz | 482/121 |
| 5,988,406 | * | 11/1999 | Leipziger | 211/41.9 |
| 6,059,698 | * | 5/2000 | Mazor | 482/79 |

* cited by examiner

*Primary Examiner*—Alvin Chin-Shue
*Assistant Examiner*—Khoa Tran
(74) *Attorney, Agent, or Firm*—James Ray & Associates

(57) ABSTRACT

A rack for dishes in a dishwasher comprises a grid for supporting the dishes and an element mounted to the grid for pivoting towards and away from the grid. The rack also includes elastic cords and a latch mechanism for arresting the element. The elastic cords are mounted in the element to be engaged, yielding against the dishes supported in the rack by pivotal movement of the element towards the grid. The latch mechanism arrests the element in different pivoted positions with the elastic cords stretched against the dishes.

10 Claims, 3 Drawing Sheets

RACK FOR DISHES IN A DISHWASHER

FIELD OF THE INVENTION

Figure 1:
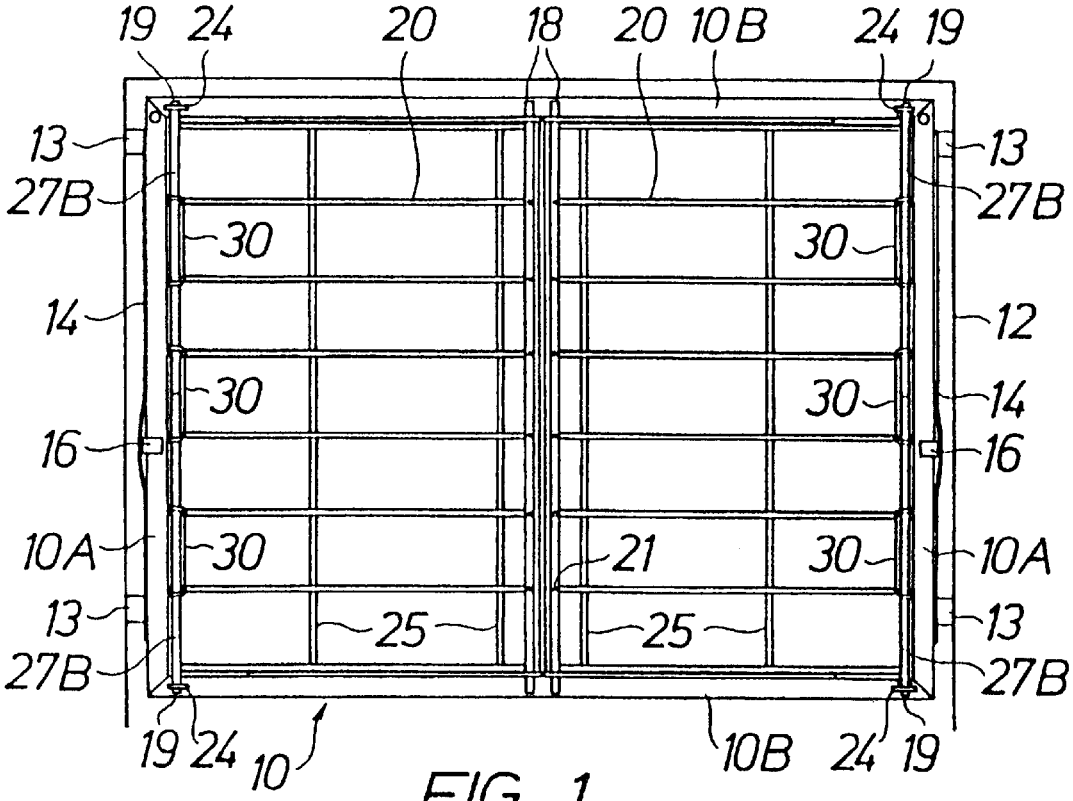

The invention relates to a rack for dishes in a dishwasher, comprising a grid for supporting the dishes.

BACKGROUND OF THE INVENTION

One or more such racks are provided in any dishwasher the grid wires then being bent in such a way that the dishes, such as plates, cups, and glasses can be supported on the grid in an upright position or in a more or less inclined position. As far as a common dishwasher is concerned the pressure at which water during the cleansing is ejected towards the dishes is not higher than the dishes will remain standing in the intended position thereof, possibly except smaller and lighter objects of metal sheet or plastics. In heavy-duty dishwashers for restaurants and large kitchens the pressure of the water is considerably higher, particularly in case of dishwashers operating with granules, wherein the water with plastic granules entrained therein is ejected towards the dishes during the cleansing, and it is therefore necessary that the dishes which in case of heavy-duty dishwashers generally comprise larger vessels are kept in a fixed position during the cleansing. In heavy-duty dishwashers there are therefore provided special, mostly exchangeable holders for standardized vessels (Gastronorm). However, the problem is that these holders must be shaped and dimensioned for different ranges of the size of the vessels and must be exchanged when changing from cleansing of vessels in one size region to cleansing of vessels in another size region, and that it may be difficult to place the vessels in the holders and to remove them therefrom because some accurate fit between vessel and holder is required in order that the vessels shall not shake in the holders and cause noise during the cleansing. Moreover, the holders are expensive in manufacture. Additionally, special inserts are required for such dishes which are not of a standardized embodiment, for example pots, saucepans, large beaters, etc.

U.S. Pat. No. 5,294,008 discloses a dishwasher rack having a net of elastic cords, which is hooked to the dishwasher rack and is stretched over the dishes supported on the rack so that dishes of different shapes and sizes placed in the rack will be retained in such position that there is no risk that the dishes will capsize under the influence of the liquid pressure acting on the dishes. The drawback of this prior art device is that the mounting of the net on the dishwasher rack is a relatively time consuming piece of work which comprises hooking the net to the rack at different positions.

U.S. Pat. No. 4,732,291 relates to a dishwasher rack for dishes comprising small objects such as baby nipples and parts of baby bottles, and this dishwasher rack comprises pivoted wire grids for enclosing the objects in a wire basket in a cage-like manner by the wire grids closing the wire basket as lids at the top and bottom thereof. As far as the dishes include objects which need to be retained this is effected by retaining the object in the dishwasher rack itself.

According to U.S. Pat. No. 3,752,322 the dishes are retained in a dishwasher rack by the rack including pivotable wire grids on which the dishes are placed and which are shaped such that they can be engaged with the dishes by pivoting in order to retain the dishes on the dishwasher rack. This method of retaining the dishes is not suitable for delicate dishes and cannot be applied to objects of any size and shape.

SUMMARY OF THE INVENTION

In a presently preferred embodiment, the invention provides a novel rack for dishes in a dishwasher. The rack comprises a grid for supporting the dishes and an element mounted to the grid for pivoting towards and away from the grid. The rack also includes elastic cords and a means for arresting the element. The elastic cords are mounted in the element to be engaged, yielding against the dishes supported in the rack by pivotal movement of the element towards the grid. The means permits the element to be arrested in different pivoted positions with the elastic cords stretched against the dishes.

BRIEF DETAILED DESCRIPTION OF THE INVENTION

Figure 2:
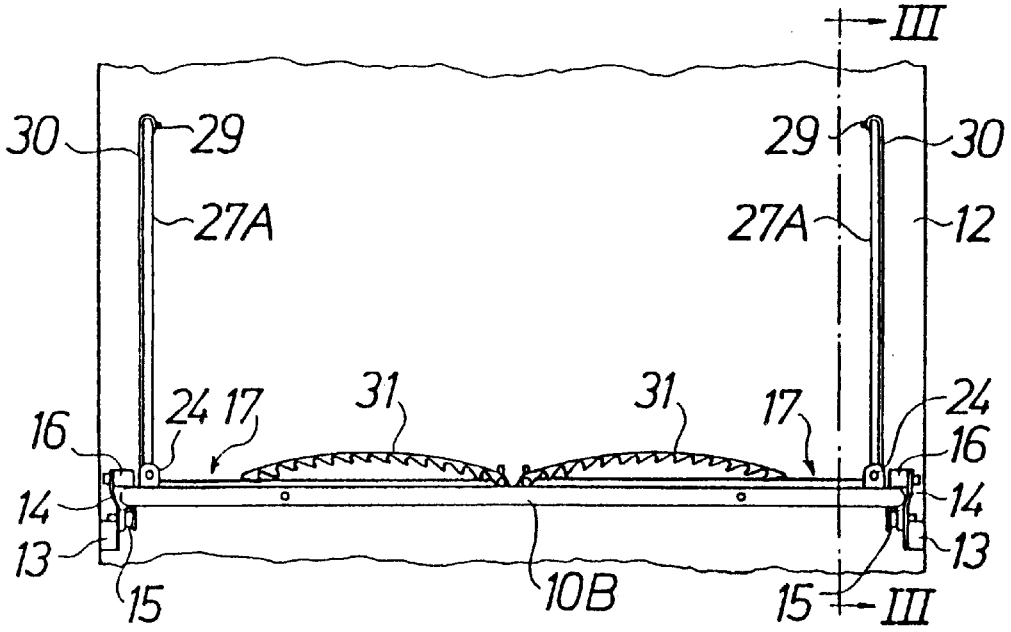
Figure 3:
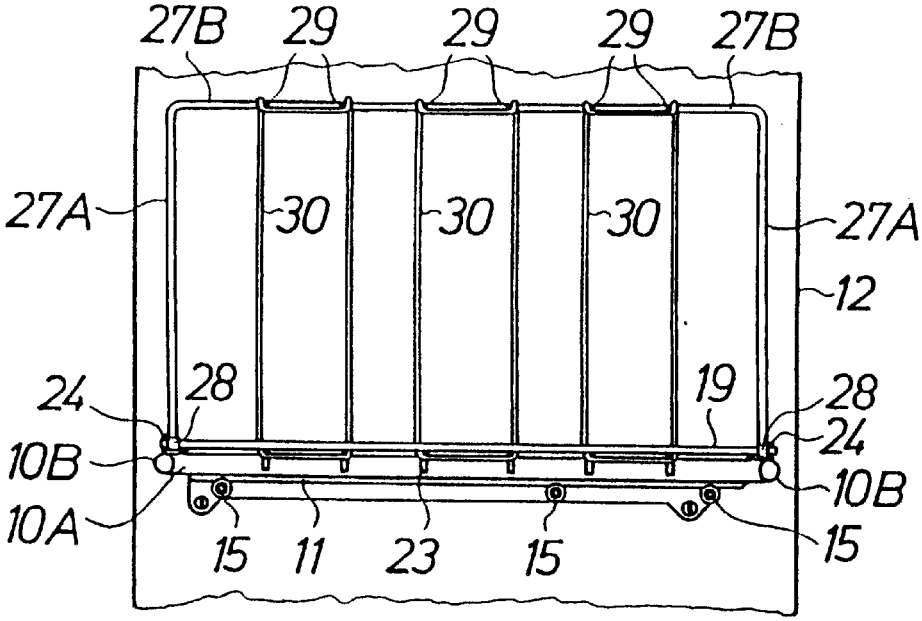
Figure 4:
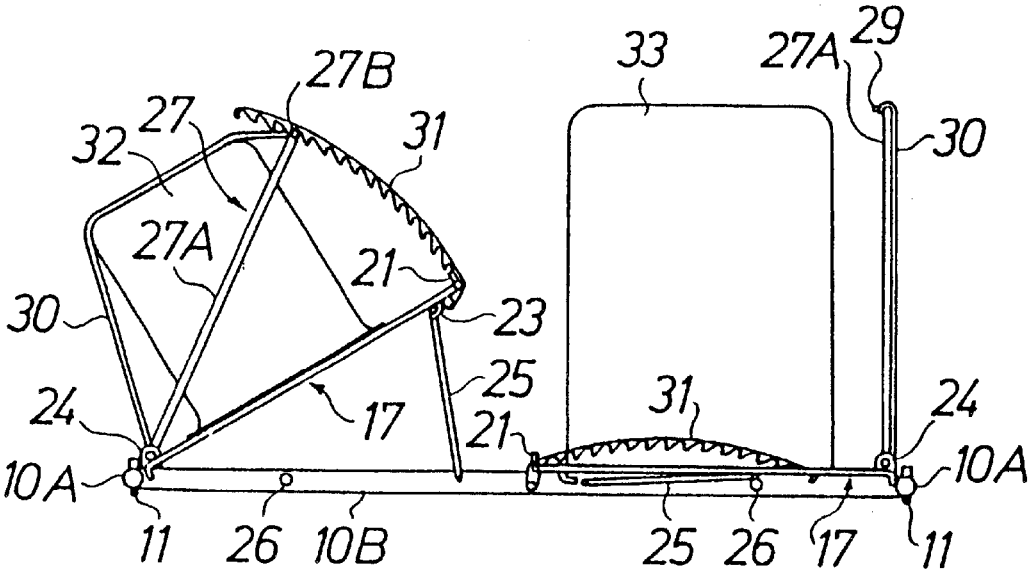
Figure 5:
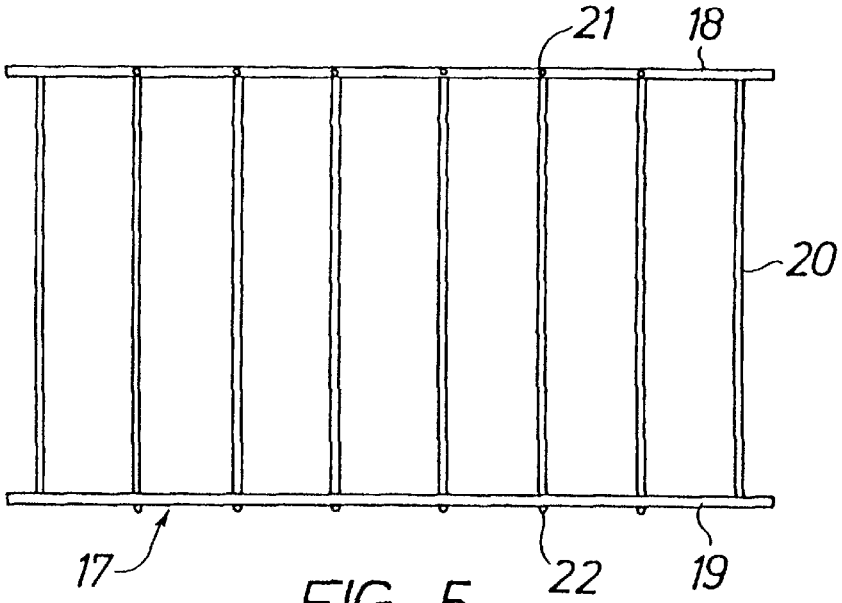
Figure 6:
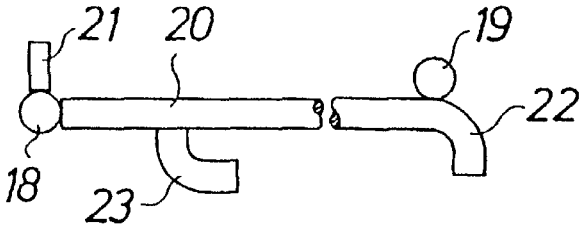
Figure 7:
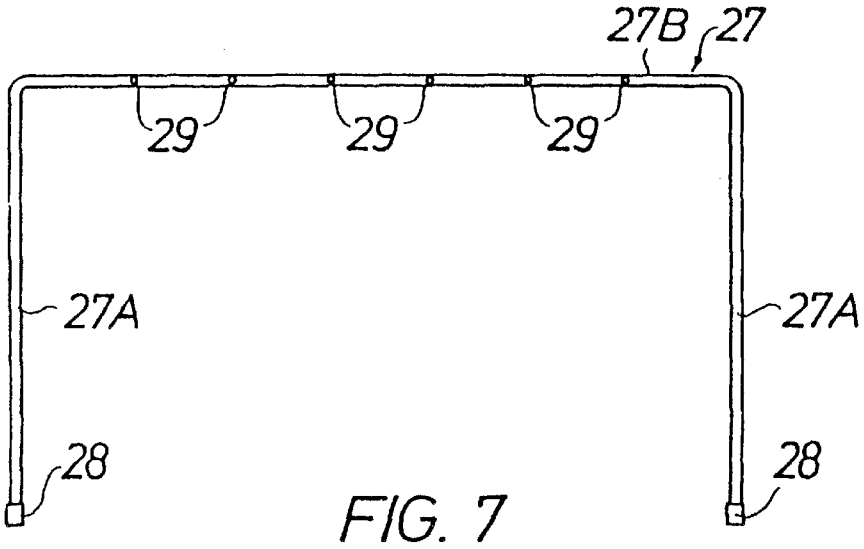

In order to explain the invention in more detail an illustrative embodiment thereof will be described below reference being made to the accompanying drawings in which FIG. 1 is a plan view of the dishwasher rack located in a dishwasher, FIG. 2 is a front view of the dishwasher rack in FIG. 1, FIG. 3 is a side view along line III—III in FIG. 2 of pivoted elements forming part of the dishwasher rack with elastic strings attached to said elements, FIG. 4 is a view similar to FIG. 2 and illustrates the location of dishes in the dishwasher rack, FIG. 5 is a plan view of a grid forming part of the rack, FIG. 6 is an enlarged broken end view of the grid, and FIG. 7 is a side view of elements for supporting the elastic cords.

DETAILED DESCRIPTION OF THE INVENTION

The dishwasher rack disclosed in the drawings comprises a rectangular frame 10 of tubing which on the lower side thereof is provided with a longitudinally extending round bar 11 having bevelled ends, along two opposite sides 10A, FIGS. 3 and 4. On the inside surface of two opposite walls of a dishwasher cabinet 12 of metal sheet fragmentarily disclosed in FIGS. 1 to 3 there is attached with intermediate rubber dampers 13 a metal sheet rail 14 extending horizontally along the inside surface and having three grooved rollers 15 fixedly mounted to the rail said rollers preferably being made of plastics, for example acetal resin. Frame 10 can be pushed into the dishwasher on these rollers. Then, the frame slides on the rollers which thus do not rotate, and the round rods 11 are guidingly received in the roller grooves. Mounted on each rail 14 is a roller 16 which is also fixedly attached and after the frame having been pushed into the dishwasher over an initial distance will engage the upper side of the frame at said opposite sides 10A of the frame in order to prevent the frame from being lifted from rollers 15. Also rollers 16 preferably consist of acetal resin.

Two grids 17, FIGS. 5 and 6, are provided on frame 10 and each comprise two round rods 18 and 19 extending parallelly and transverse round rods 20, eight in the number, which are attached to rods 18 and 19 and extend parallelly mutually spaced and perpendicularly to rods 18 and 19. On rod 18 there are welded to this rod at the positions where rods 20—except the two outermost rods thereof—are attached to rod 18, pins 21 extending perpendicularly to rods 20 which at the end surface thereof are welded to rod 18. At the other end rods 20 extend below rod 19 and are welded to this rod at the lower side thereof. A downwardly bent end portion 22 extends beyond rod 19. A hook 23 is welded to the rods 20 which are next to the outermost of rods 20 slightly spaced from rod 18, and this hook is facing rod 19 and is located in the same plane as the downwardly bent end portion 22. Rods 18 and 19 project from the outermost rods 20 at both ends thereof. Each grid is pivotally mounted to frame 10 by the projecting end portions of rod 19 being inserted into lugs 24 attached to the frame, and projecting from the upper side thereof on the other two opposite sides 10B of the rectangular frame 10. Each grid has a folded down horizontal position wherein the grid at the projecting end portions of bar 18 rests against the upper side of the frame, but it can be swung upwards from this horizontal position and can be arrested in an inclined position. For arresting the grid a yoke 25 is pivotally mounted to frame 10 at the inside thereof in said other two opposite sides 10B said yoke when not in use being folded down against two abutments 26 provided on the inside of the frame. When the grid shall take an inclined position the yoke is swung upwards and inserted into hooks 23 as disclosed in FIG. 4.

On each of the projecting ends of bar 19, said ends being pivotally mounted in lugs 24, a U-shaped yoke 27 of round bar is pivotally mounted, FIG. 7, by mounting sockets 28 at the ends of limbs 27A being passed onto bar 19 the web 27B of the yoke extending in parallel with bar 19. Pins 29 are attached to web 27B said pins projecting perpendicularly from the web. Three rubber cords 30 consisting of O-rings are each hooked onto two pins 29 located adjacent each other and under elastic stretching are extended in parallel with limbs 27A to and around bar 19 in order then to be hooked onto two end portions 23 bent downwards, which are located adjacent each other. Yokes 27 take the position disclosed in FIGS. 1 to 3 wherein limbs 27A are in a substantially vertical or slightly rearwardly inclined position by the yoke resting against an abutment (not shown) or against the wall of cabinet 12. On each side of grid 17 there is pivotally mounted on bar 18 a latch element 31 consisting of a slightly curved metal sheet rail having a number of notches formed therein and distributed along the rail said notches being adapted for engagement with the web 27B of yoke 27.

In FIG. 4 there is shown how the rack described is used. A vessel 32 is located with the opening towards one grid 17 and is tightened against this grid by yoke 27 having been swung downwards towards the grid under tensioning of the rubber cords 30 against the vessel the yoke then having been arrested in a suitable pivoted position by means of latch elements 31 so that the vessel is held pressed against the grid by a sufficiently great force in order not to be lifted from the grid under influence of the pressure exerted against the vessel during cleansing by the water ejected against the vessel. The water may have granules entrained therein. Grid 17 is adjusted to an inclined position by yoke 25 being engaged with hooks 23 in order that the interior of the vessel shall be most efficiently sprayed during the cleansing. The inclined position has to be adjusted to the spray pattern in the dishwasher, and it is possible to arrange the grid in such a way that it can be adjusted to more than one inclined position, for example by arranging two or more hooks 23 along rods 20. Pins 21 on the grid prevent the vessel from sliding off the grid if the vessel due to the pressure exerted against the vessel by rubber cords 30 should tend to slide towards the edge of the grid during cleansing. Another larger vessel 33 is shown to be supported on the other grid 17 located in a horizontal position, without being tightened because it is presupposed to be so heavy that it cannot be dislodged on the grid during the cleansing.

The device described for tightening the vessels on the grid is not depending of a specific shape or size of the vessels; it allows safe retention of the dishes on the grid independent of existing shape and size.

It is practical to provide rubber cords consisting of O-rings allowing a simple and safe attachment of the rubber cords. It is however, also possible to provide simple rubber strings which are attached at one end to yoke 27 and at the other end to the bent end portions 23 of grid 17, or to provide a rubber string as a meander line between yoke 27 and grid 17. It may be suitable to provide some type of clip for attaching the rubber strings so that they do not get loose if they should rupture and arrive at the pump system of the dishwasher. The rubber cords can be replaced by helical springs which have the drawback, however, that granules can get stuck between the winding turns. In a preferred embodiment the helical springs therefore are enclosed by a protecting hose of plastics or rubber.

What is claimed is:

1. Rack for dishes in a dishwasher comprising:

(a) a grid for supporting the dishes, said grid being pivotally mounted to a frame of said rack and arrestable in one or more inclined positions;

(b) an element mounted to said grid pivotable towards and away from said grid;

(c) elastic cords mounted on said element to be engaged yielding against the dishes supported in said rack by pivotal movement of said element towards said grid; and (d) means for arresting said element in different pivoted positions with said elastic cords stretched against the dishes.

2. Rack as in claim 1, wherein said means for arresting said element comprises a rail pivotally mounted to said grid and having a number of notches distributed along said rail for locking engagement with said element.

3. Rack as in claim 2, wherein said elastic cords are stretched between said element and said grid.

4. Rack as in claim 2, wherein said elastic cords comprise rubber straps or strings.

5. Rack as in claim 2, wherein said elastic cords comprise O-rings.

6. Rack as in claim 1, wherein said elastic cords are stretched between said element and said grid.

7. Rack as in claim 6, wherein said elastic cords comprise rubber straps or strings.

8. Rack as in claim 6, wherein said elastic cords comprise O-rings.

9. Rack as in claim 1, wherein said elastic cords comprise rubber straps or strings.

10. Rack as in claim 1, wherein said elastic cords comprise O-rings.

* * * * *